US006840514B1

(12) United States Patent
Westhoff

(10) Patent No.: US 6,840,514 B1
(45) Date of Patent: Jan. 11, 2005

(54) MEDIA ALIGNMENT MECHANISM

(75) Inventor: Daniel Joseph Westhoff, Georgetown, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 10/694,240

(22) Filed: Oct. 27, 2003

(51) Int. Cl.[7] ..... B65H 9/16
(52) U.S. Cl. ..... 271/248; 271/250; 271/251
(58) Field of Search ..... 271/248, 250, 271/251

(56) References Cited

U.S. PATENT DOCUMENTS 4,110,030 A 8/1978 Knechtel
4,786,045 A * 11/1988 Sam ..... 271/251
5,729,816 A * 3/1998 Matsumoto et al. ..... 399/381
5,967,511 A * 10/1999 Bell ..... 271/252
6,042,110 A * 3/2000 Inage ..... 271/251
6,164,643 A * 12/2000 Otsuka ..... 271/250

* cited by examiner

*Primary Examiner*—David H. Bollinger
(74) *Attorney, Agent, or Firm*—Frank C. Leach, Jr.; John A. Brady

(57) ABSTRACT

A media alignment mechanism of a printer having duplex capabilities has two spaced elements (33, 34) defining a predetermined return feed path. Two reference edge segments (50, 61) are disposed between the spaced elements and separated from each other in the direction of advancement of each sheet of media. The spaced elements have non-linear portions extending between the two separated reference edge segments and shaped to break the beam of the sheet of media. This allows a side surface (68) of each sheet of media to simultaneously engage each of the two separated reference edge segments even though the first reference edge segment is at angle to the second reference edge segment to prevent the leading edge of the sheet of media from engaging the entry end (66) of the second reference segment, which provides the desired alignment of the sheet of media for its return to the printer for printing on its second side.

22 Claims, 9 Drawing Sheets

MEDIA ALIGNMENT MECHANISM

FIELD OF THE INVENTION

This invention relates to a media alignment mechanism and, more particularly, to a media alignment mechanism in which each sheet of media is aligned with a specific reference edge during its movement along a predetermined path.

BACKGROUND OF THE INVENTION

In a printer having a duplexer, each sheet of media has to be repositioned relative to a desired location in the media return path of the duplexer prior to the sheet of media being returned into the media input path of the printer. Repositioning of the sheet of media is required due to the sheet of media possibly being misaligned during its initial advancement through the printer when printing occurs on a first side of the sheet of media.

This misalignment may be to the left or right of the desired location of the sheet of media. The sheet of media also may be angled relative to its desired location. To have accurate positioning of each sheet of media during its return to the printing area of the printer so that printing on a second side of the sheet of media is accurate, the sheet of media must be accurately repositioned relative to a known location.

One previously suggested arrangement for repositioning each sheet of media in a duplexer has been to move a side surface of the sheet of media away from a reference edge, which provides the desired alignment location of the sheet of media, and then return the side surface of the sheet of media into alignment with the reference edge during its return to the printing area of the printer. This would insure that the sheet of media, which would interfere with the reference edge due to its misalignment, is positioned away from the reference edge when the leading edge of the sheet of media enters the entrance to the reference edge.

One prior arrangement for moving the sheet of media away from the reference edge has utilized a cam shifting mechanism to move the sheet of media in one direction away from the reference edge so that the reference edge alignment mechanism can align the sheet of media with the reference edge by movement of the sheet of media in the opposite direction until the sheet of media is aligned to the desired location relative to the reference edge. However, this cam shifting mechanism is relatively expensive. It also has some reliability problems due to design complexity.

In a printer having a media path with both simplex and duplex capabilities, a single sheet of media is separated from the top of a stack of sheets of media in a media tray. The sheet of media is then transported through a printer during its printing process.

In a duplex operation, the direction of motion of the sheet of media is reversed after its trailing edge is released from fuser exit rollers of a laser printer, for example. After the direction of motion of the sheet of media is reversed, it must be realigned in the duplexer path to the correct position and orientation prior to entering again into the printer input path. To align the sheet of media with the reference edge to its correct position and orientation, alignment rollers have previously been employed. These alignment rollers are skewed so that they apply both a force perpendicular to the reference edge and a force parallel to the reference edge to advance the sheet of media.

However, when the leading edge of a sheet of media enters the entrance to the reference edge, it could engage the entry end of the reference edge and create a paper jam. This is because the position and orientation of the sheet of media is not known when the leading edge of the sheet of media enters the entrance to the reference edge in its duplex operation. Accordingly, it is necessary to insure that the sheet of media does not engage the entry end of the reference edge when the sheet of media is to be printed on its second side.

One possible arrangement would be to form an angled entry portion reference edge so that the entry portion is not in a position to be engaged by any sheet of media that enters it. However, this creates the problem of the angled reference edge disposing the sheet of media so that it is not returned to the printer in the correct orientation.

If the reference edge were designed with two contiguous segments with the first segment angled to allow for entry of each sheet of media into the entrance of the reference edge and a second reference edge segment oriented for proper presentation of the sheet of media for its return to the printer for printing on its second side, this would appear to solve the problem. However, this arrangement results in a side surface of the sheet of media being forced simultaneously against two media engaging surfaces of the reference edge at an angle to each other. This would cause the sheet of media to be stressed, and the sheet of media may be damaged during alignment.

The media alignment mechanism of the present invention satisfactorily solves the foregoing problem through forming the reference edge of two segments separated from each other by a non-linear portion. The non-linear portion preferably has an S shape in the predetermined media feed path during its return to the printer although any suitable non-linear shape may be employed. The non-linear portion of the media path allows each sheet of media to be aligned simultaneously with each of the two spaced reference edge segments without inducing significant stress in each sheet of media. This avoids any damage to the sheet of media.

When the sheet of media is in the non-linear portion of the media path, the beam of the sheet of media is broken. This allows a side surface of the sheet of media to become aligned with the media engaging surface of the second reference edge segment with which the sheet of media is aligned to return to the printing area of the printer in the desired alignment while the side surface of the sheet of media is still engaging the media engaging surface of the first reference edge segment.

The media alignment mechanism enables entry of each sheet of media into the entrance of the first reference edge segment even when the sheet of media would be in interference with the desired position as defined by the second reference edge segment. The media engaging surface of the first reference edge segment is angled away from the advancing sheet of media to prevent interference between the sheet of media and the entry end of the first reference edge segment. The non-linear portion of the media path of the sheet of media turns the sheet of media between the two reference edge segments to allow the sheet of media to be aligned simultaneously with the media engaging surface of each of the two reference edge segments.

This arrangement breaks the beam of the sheet of media. This arrangement enables the sheet of media to move from alignment with the media engaging surface of the first reference edge segment into alignment with the media engaging surface of the second reference segment.

Each of the two reference edge segments has a separate advancing means for advancing each sheet of media. Each of these advancing means provides both a force substantially perpendicular to the media engaging surface of the reference edge segment and a force parallel to the media engaging surface of the reference edge segment in the same manner as previously used.

During the movement of the sheet of media along the media engaging surface of the first reference edge segment, its leading edge is free to move laterally. This allows alignment of the sheet of media with the media engaging surface of the second reference edge segment by its advancing means when the sheet of media is constrained by the media engaging surface of the first reference edge segment.

As the sheet of media is advanced, one of its side surfaces engages the media engaging surface of the second reference edge segment with this engaging side surface of the sheet of media being shortened in the non-linear portion of the media path while the opposite side surface is lengthened therein. This results from the breaking of the beam of the sheet of media.

SUMMARY OF THE INVENTION

This invention relates to a media alignment mechanism for aligning each sheet of media with a reference edge for providing a desired media alignment direction during its advancement along a predetermined path comprising a pair of spaced elements defining the predetermined path along which each sheet of media is advanced and having a substantially constant space therebetween. A first reference edge segment is supported for disposition between the pair of spaced elements with the first reference edge segment having a media engaging surface for initially engaging a portion of a sheet of media as it is advanced relative to the first reference edge segment. First media advancing means advance a side surface of the sheet of media into the media engaging surface of the first reference edge segment and along the media engaging surface of the first reference edge segment. A second reference edge segment is spaced from the first reference edge segment in the direction of advancement of the sheet of media with the second reference edge segment supported for disposition between the pair of spaced elements with the second reference edge segment having a media engaging surface for engaging a portion of the sheet of media as it is advanced relative to the second reference edge segment. Second advancing means advance the side surface of the sheet of media into the media engaging surface of the second reference edge segment and along the media engaging surface of the second reference edge segment to align the sheet of media with the media engaging surface of the second reference edge segment. The second reference edge segment has the media engaging surface providing the desired media alignment direction. Each of the pair of spaced elements has a non-linear portion between the first reference edge segment and the second reference edge segment for supporting and guiding the sheet of media during its advancement from the first reference edge segment to the second reference edge segment. The non-linear portions have a shape to break the beam of the sheet of media during its advancement through the space between the non-linear portions to enable a side surface of the sheet of media to be moved by the second advancing means into alignment with the media engaging surface of the second reference edge segment when the sheet of media engages the media engaging surface of the second reference edge segment while the side surface of the sheet of media is simultaneously in engagement with the media engaging surface of the first reference edge segment. The media engaging surface of the first reference edge segment is angled relative to the media engaging surface of the second reference edge segment so that the sheet of media has its leading edge pass inwardly of a media entry end of the second reference edge segment after its advancement through the space between the pair of non-linear portions to insure that the leading edge of the sheet of media does not engage the media entry end of the second reference edge segment.

This invention also relates to a method of aligning each sheet of media with a reference edge during its advancement along a predetermined path to provide a desired media alignment comprising advancing a sheet of media along the predetermined path to initially engage a media engaging surface of a first reference edge segment, disposed at a predetermined position along the predetermined path, for advancement of the sheet of media into engagement with the media engaging surface of the first reference edge segment and along the first reference edge segment, advancing the sheet of media along the predetermined path to engage a media engaging surface of a second reference edge segment spaced from the media engaging surface of the first reference edge segment in the direction of advancement of the sheet of media and in a direction to clear the entry end of the media engaging surface of the second reference edge segment due to the media engaging surface of the first reference edge segment being at an angle to the media engaging surface of the second reference edge segment to so direct the sheet of media, and breaking the beam of the sheet of media between the first reference edge segment and the second reference edge segment to enable a side surface of the sheet of media to move into engagement with the media engaging surface of the second reference edge segment while the sheet of media is simultaneously engaging the media engaging surface of the first reference edge segment as the sheet of media is advanced to align the sheet of media with the media engaging surface of the second reference edge segment to provide the desired media alignment.

BRIEF DESCRIPTION OF THE DRAWINGS

The attached drawings illustrate an exemplary embodiment of the invention, in which.

DETAILED DESCRIPTION OF AN EXEMPLARY EMBODIMENT

Figure 1:
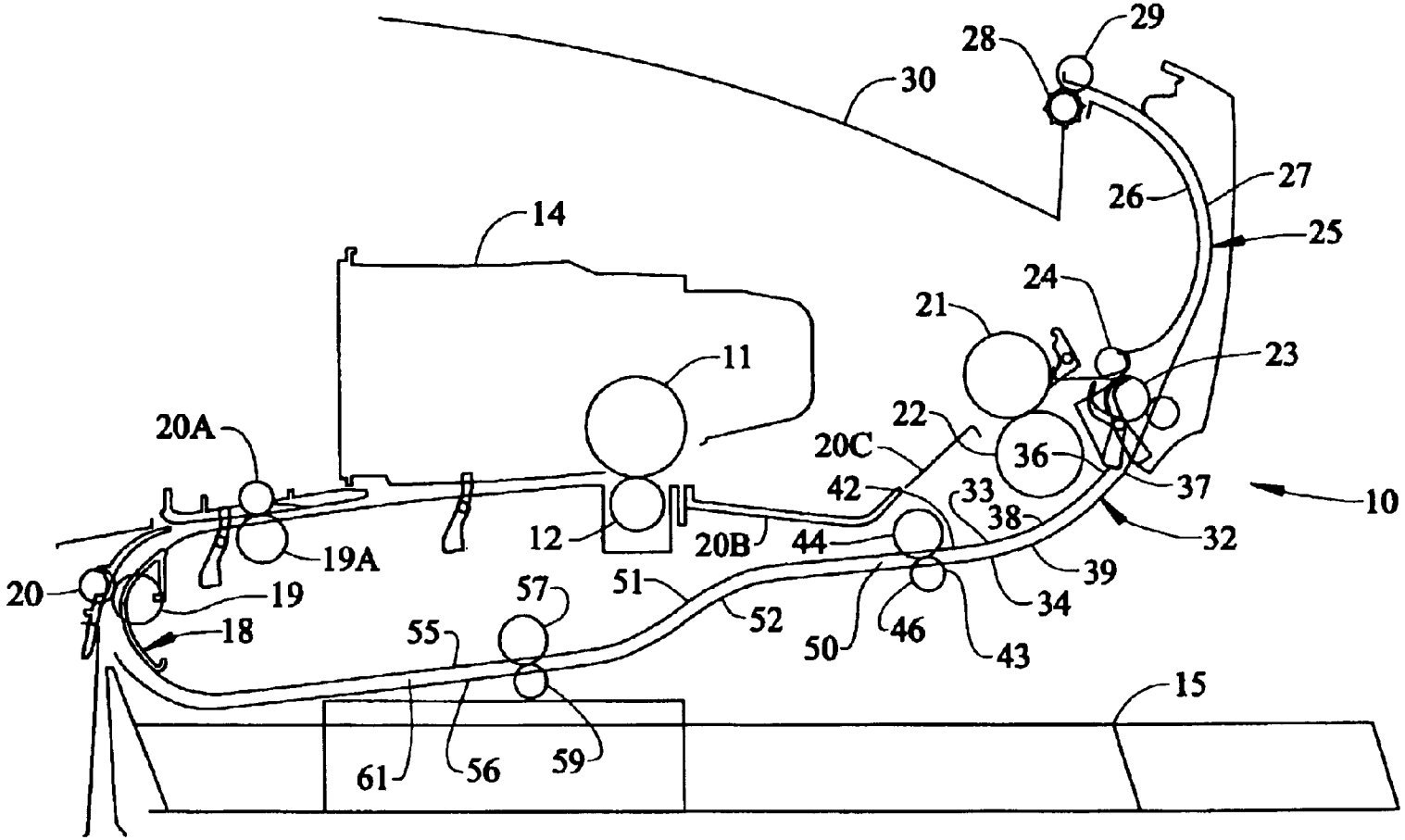
FIG. 1 is a schematic side elevational view of a portion of a printer having a media alignment mechanism of the present invention with parts omitted for clarity purposes and taken from the right side.

Referring to the drawings and particularly FIG. 1, there is shown a laser printer 10 having a printing area including a photoconductive drum 11 and a toner transfer roll 12 cooperating with each other and receiving toner from a cartridge 14. The laser printer 10 has a media tray 15 from which each sheet 16 (see FIG. 3) of media is picked is picked in the well-known manner for supply to a predetermined feed path 18 (see FIG. 1) for feeding the sheet 16 (see FIG. 3) of media to the printing area.

The predetermined feed path 18 (see FIG. 1) has drive rollers 19 and 19A cooperating with idler rollers 20 and 20A, respectively, to advance the sheet 16 (see FIG. 3) of media between the photoconductive drum 11 (see FIG. 1) and the toner transfer roll 12 for printing a desired image on the sheet 16 (see FIG. 3) of media. After exiting from the photoconductive drum 11 (see FIG. 1) and the toner transfer roll 12, the sheet 16 (see FIG. 3) of media is advanced across a transfer plate 20B (see FIG. 1) and a fuser input guide 20C before it passes through a nip formed between a pair of exit fuser rollers 21 and 22 to fuse the printed image on the sheet 16 (see FIG. 3) of media.

The sheet 16 of media is advanced from the exit fuser rollers 21 (see FIG. 1) and 22 to a nip formed between a drive roller 23 and a first idler roller 24 cooperating with the drive roller 23 for advancing the sheet 16 (see FIG. 3) of media along a predetermined exit path 25 (see FIG. 1). The predetermined exit path 25 is formed by a pair of spaced elements 26 and 27 having a substantially constant gap therebetween.

The sheet 16 (see FIG. 3) of media is advanced by the drive roller 23 (see FIG. 1) and the first idler roller 24 to a nip formed by a drive roller 28 and an idler roller 29 at the end of the predetermined exit path 25. When the sheet 16 (see FIG. 3) of media is to be printed on only one side, the sheet 16 of media is advanced past the nip formed by the drive roller 28 (see FIG. 1) and the idler roller 29 to a collector surface 30 or other suitable collection area.

When the sheet 16 (see FIG. 3) of media is to be printed on both sides, the direction of rotation of the drive roller 28 (see FIG. 1) is reversed after the sheet 16 (see FIG. 3) of media has its trailing edge advanced past the drive roller 23 (see FIG. 1) and the idler roller 24. This results in the trailing edge of the sheet 16 (see FIG. 3) of media becoming the leading edge as it is advanced by the drive roller 28 (see FIG. 1). Prior to the sheet 16 (see FIG. 3) of media exiting from the drive roller 23 (see FIG. 1) and the first idler roller 24, the sheet 16 (see FIG. 3) of media is between the drive roller 28 (see FIG. 1) and the idler roller 29.

The sheet 16 (see FIG. 3) of media is advanced by the drive roller 28 (see FIG. 1) into a nip formed between the drive roller 23 and a second idler roller. This starts return of the sheet 16 (see FIG. 3) of media to the predetermined feed path 18 (see FIG. 1) through a duplexer 32.

The duplexer 32 includes a pair of spaced elements 33 and 34 between which each of the sheets 16 (see FIG. 3) of media is advanced when it is to be printed on its second side. Thus, the spaced elements 33 (see FIG. 1) and 34 define a predetermined return feed path 35 for each of the sheets 16 (see FIG. 3) of media.

The spaced elements 33 (see FIG. 1) and 34 include media entrance portions 36 and 37, respectively, to initially receive the sheet 16 (see FIG. 3) of media. The media entrance portions 36 (see FIG. 1) and 37 have curved end portions 38 and 39, respectively.

Figure 2:
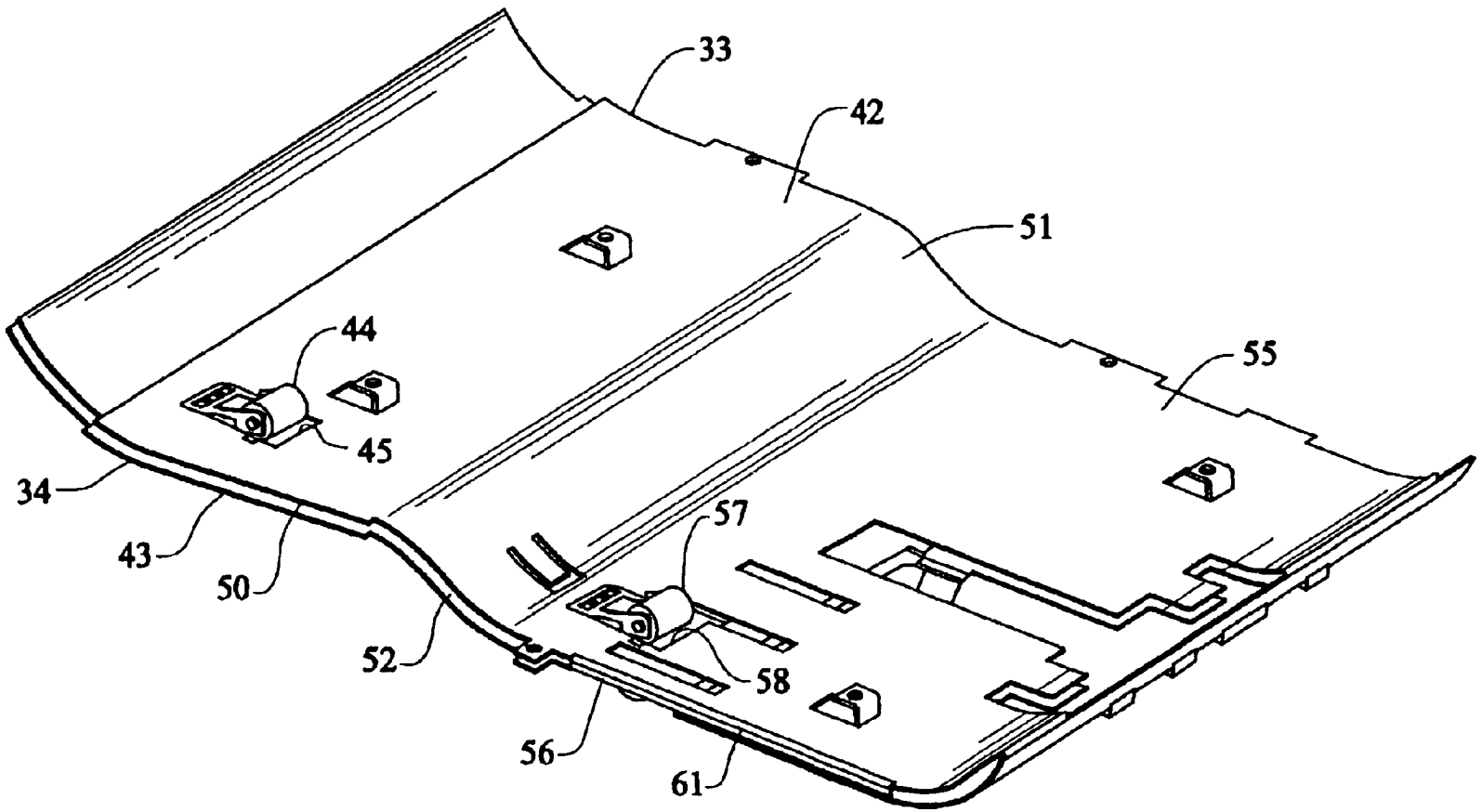
FIG. 2 is a perspective view of the media alignment mechanism and showing two reference edge segments with non-linear portions therebetween.

The curved end portions 38 and 39 are connected to first straight portions 42 and 43, respectively, between which each of the sheets 16 (see FIG. 3) of media is advanced by a drive roller 46 (see FIG. 1) active with alignment roller 44 (see FIG. 1). The alignment roller 44 extends through an opening 45 (see FIG. 2) in the first straight portion 42 of the spaced element 33 to engage each of the sheets 16 (see FIG. 3) of media. The alignment roller 44 (see FIG. 2) cooperates with a drive roller 46 (see FIG. 1), which extends through an opening (not shown) in the first straight portion 43 of the spaced element 34.

A first reference edge segment 50 (see FIG. 2) is disposed between the two first straight portions 42 and 43. The first reference edge segment 50 is preferably supported by both of the first straight portions 42 and 43 through being fixed thereto, but it is only necessary for the first reference edge segment 50 to be disposed between the first straight portions 42 and 43 and supported in a fixed position relative thereto. Thus, the first reference edge segment 50 could be supported by other suitable structure or by only one of the two first straight portions 42 and 43, if desired.

The spaced element 33 has a non-linear portion 51 extending from the termination of the first straight portion 42. The spaced element 34 has a non-linear portion 52 extending from the termination of the first straight portion 43.

The non-linear portions 51 and 52 have the same shape so that they remain substantially parallel to each other to maintain a substantially constant gap therebetween. The non-linear portions 51 and 52 preferably have an S profile, but any other suitable non-linear shape such as a C profile, for example, may be employed, if desired.

The spaced element 33 has a second straight portion 55 extending from the lower end of the non-linear portion 51. The spaced element 34 has a second straight portion 56 extending from the lower end of the non-linear portion 52. The second straight portions 55 and 56 are substantially parallel to each other to maintain the substantially constant gap therebetween.

An alignment roller 57 is supported by the second straight portion 55 of the spaced element 33 and extends through an opening 58 in the second straight portion 55 to engage each of the sheets 16 (see FIG. 3) of media. A drive roller 59 (see FIG. 1), which is supported by the second straight portion 56, cooperates with the alignment roller 57 to enable advancement of each of the sheets 16 (see FIG. 3) of media. The drive roller 59 (see FIG. 1) extends through an opening (not shown) in the second straight portion 56 to cooperate with the alignment roller 57 as the alignment roller 57 advances each of the sheets 16 (see FIG. 3) of media.

A second reference edge segment 61 (see FIG. 2) is disposed between the second straight portions 55 and 56. The second reference edge segment 61 is preferably supported by both of the second straight portions 55 and 56 through being fixed thereto, but it is only necessary for the second reference edge segment 61 to be disposed between the second straight portions 55 and 56 and supported in a fixed position relative thereto. Thus, the second reference edge segment 61 could be supported by other suitable structure or by only one of the two second straight portions 55 and 56, if desired.

Figure 3:
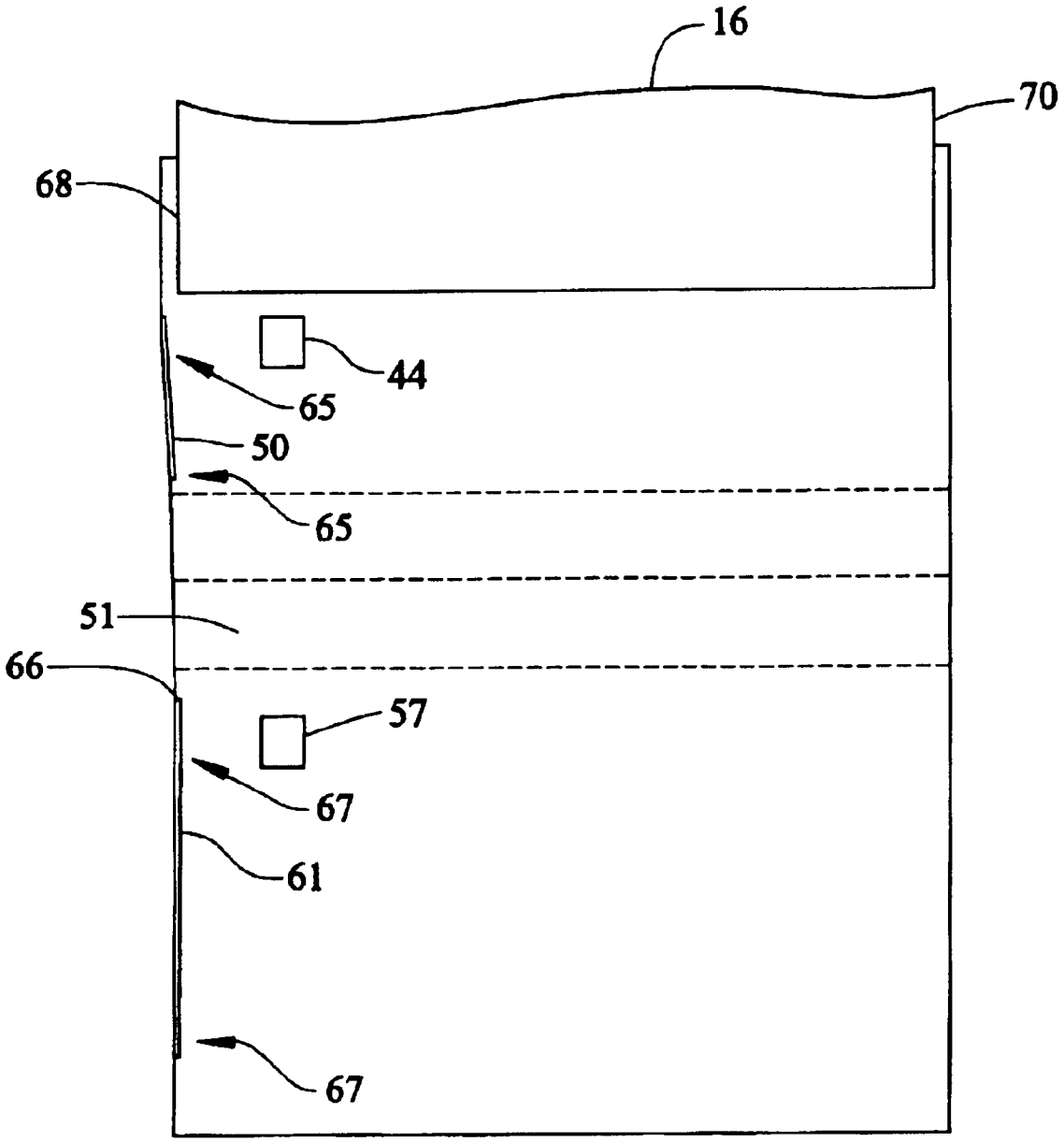
FIG. 3 is a top plan view of a portion of the media alignment mechanism of FIG. 2 and showing a sheet of media just prior to its leading edge entering the first reference edge segment.

As shown in FIG. 3, the first reference edge segment 50 has its media guide surface 65 at an angle to the second reference edge segment 61. This insures that the sheet 16 of media will not engage an entry end 66 of the second reference edge segment 61 during its advancement.

The second reference edge segment 61 has its media guide surface 67 disposed to provide the desired alignment of each of the sheets 16 of media prior to its return to the predetermined feed path 18 (see FIG. 1) of the printer 10. The alignment roller 57 advances the sheet 16 (see FIG. 3) of media to the predetermined feed path 18 (see FIG. 1) of the printer 10 for return of the sheet 16 (see FIG. 3) of media to the printing area for printing on its second side. This is the same path along which the sheet 16 of media was initially advanced from the media tray 15 (see FIG. 1) to be printed on its first side.

The alignment roller 44 (see FIG. 3) applies a force to each of the sheets 16 of media substantially perpendicular to the media guide surface 65 of the first reference edge segment 50 and a force substantially parallel to the media guide surface 65 of the first reference edge segment 50. The alignment roller 44 is preferably skewed at an angle of 5° to the feed direction of the sheet 16 of media to provide these two forces.

Figure 4:
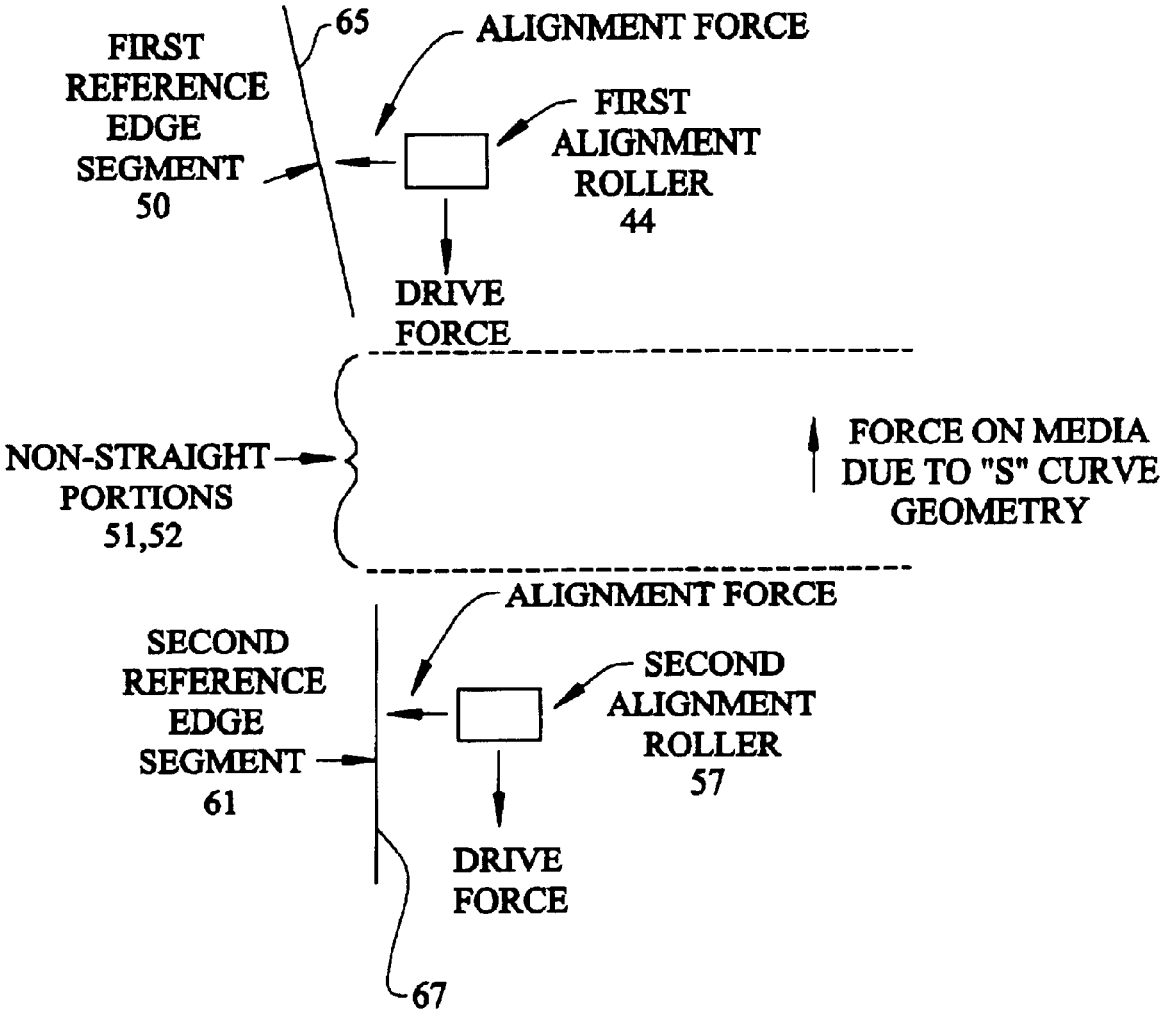
FIG. 4 is a schematic view showing the forces exerted by the alignment rollers of the media alignment mechanism of FIG. 2.

The alignment roller 57 applies a force to each of the sheets 16 of media substantially perpendicular to the media guide surface 67 of the second reference edge segment 61 and a force substantially parallel to the media guide surface 67 of the second reference edge segment 61. The alignment roller 57 is preferably skewed at an angle of 5° to the feed direction of the sheet 16 of media to provide these two forces. FIG. 4 discloses the application of these forces.

Each of the sheets 16 of media is advanced by the alignment roller 57 until its leading edge reaches the drive roller 19 (see FIG. 1) and the idler roller 20 of the predetermined feed path 18. The drive rollers 19 and 19A and the idler rollers 20 and 20A advance each of the sheets 16 (see FIG. 3) of media along the predetermined feed path 18 (see FIG. 1) as it is moved initially from the media tray 15.

Figure 5:
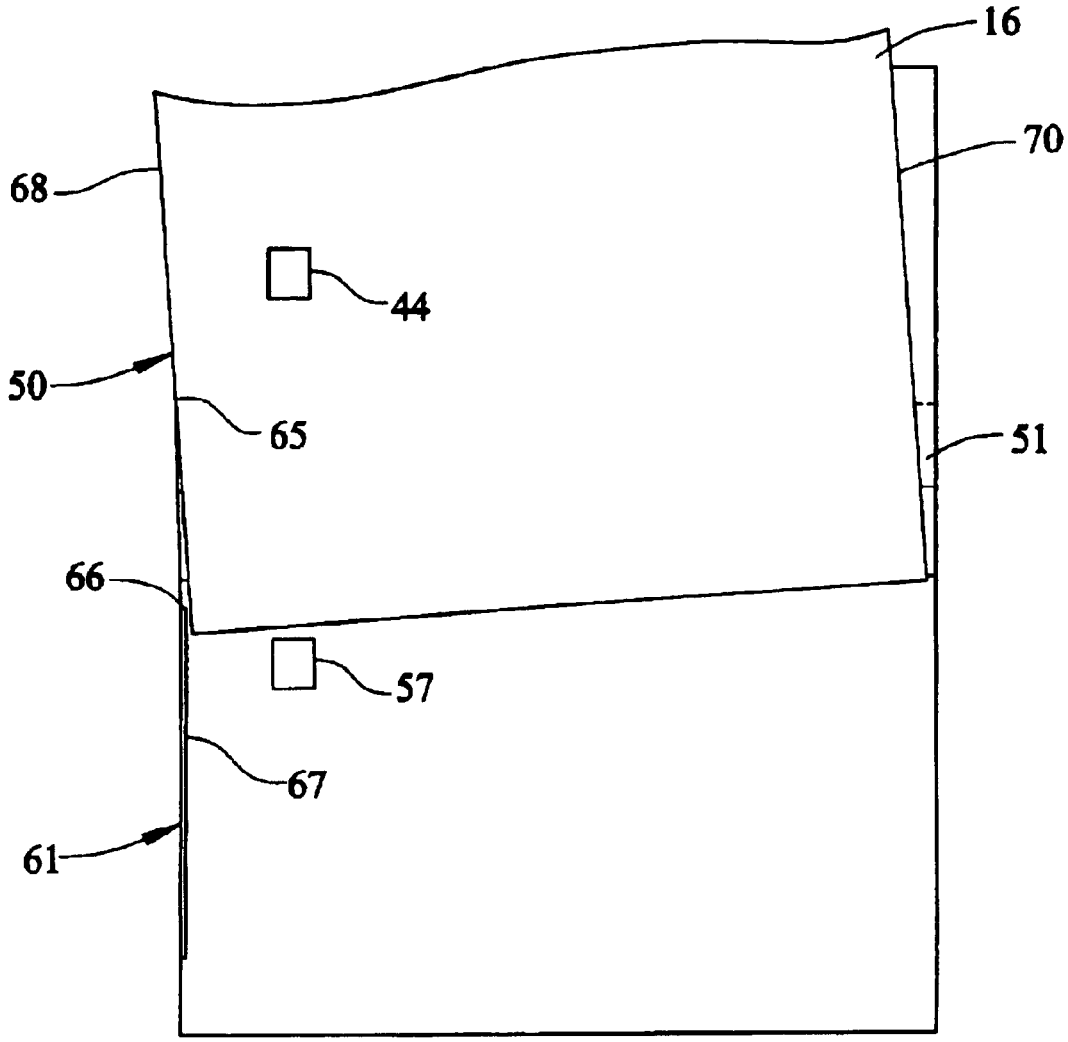
FIG. 5 is a schematic top plan view of the media alignment mechanism of FIG. 2 and showing a sheet of media just prior to its leading edge entering the second reference edge segment.
Figure 6:
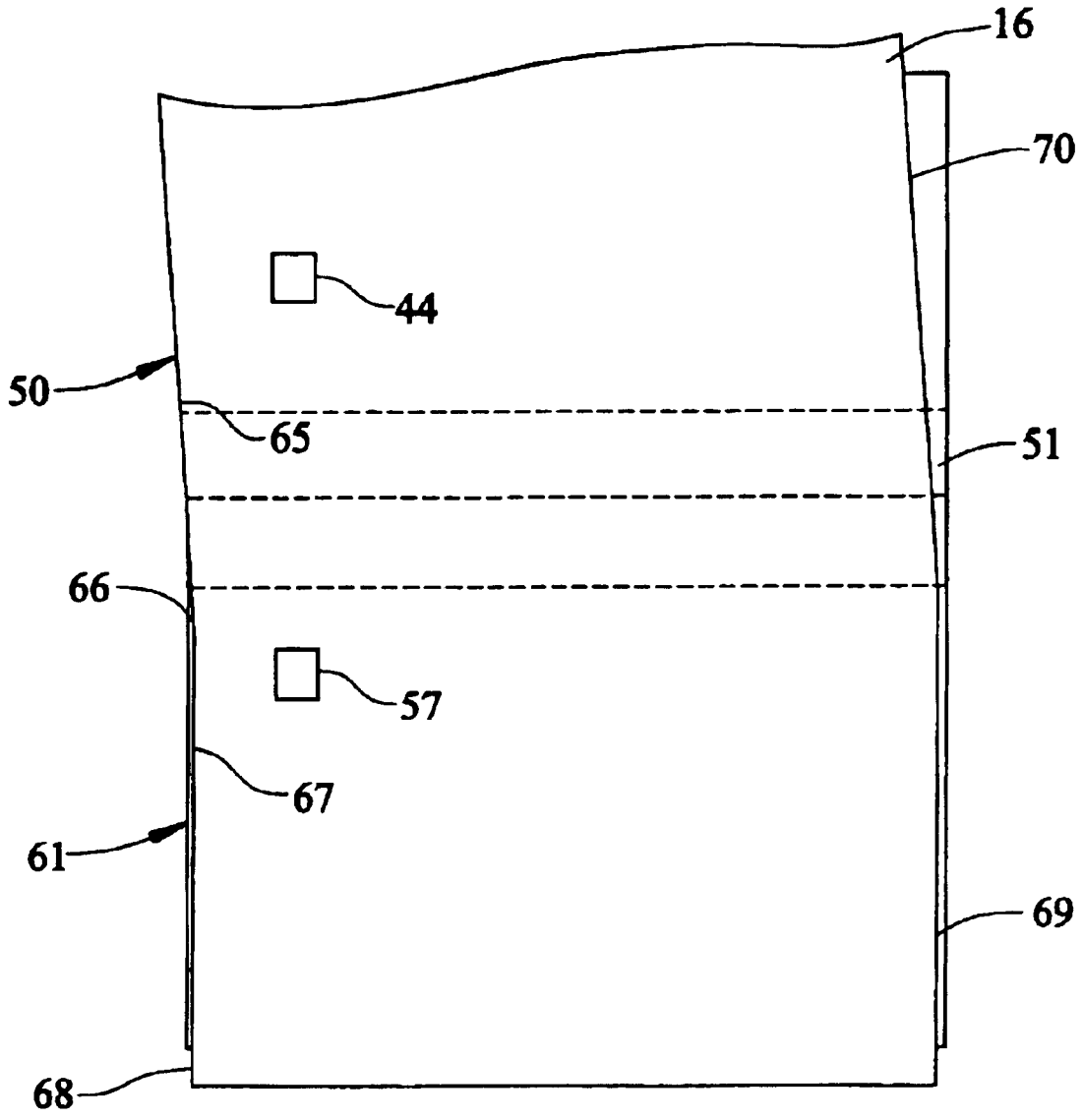
FIG. 6 is a schematic top plan view, similar to FIG. 5, of the media alignment mechanism of FIG. 2 and showing the sheet of media as its leading edge is exiting the second reference edge but the sheet of media still engaging the media engaging surface of each of the first reference edge segment and the second reference edge segment.

As the sheet 16 (see FIG. 3) of media is advanced between the spaced elements 33 (see FIG. 1) and 34, it engages the first reference edge segment 50 and has its side surface 68 ride along the media guide surface 65 (see FIG. 3) of the first reference edge segment 50. As shown in FIG. 5, the angle of the media guide surface 65 insures that the leading edge of the sheet 16 of the media will not be advanced into engagement with the entry end 66 of the second reference edge segment 61. As the sheet 16 of media passes the entry end 66 of the second reference edge segment 61, the alignment roller 57 moves the side surface 68 of the sheet 16 of media into engagement with the media guide surface 67 of the second reference edge segment 61 as shown in FIG. 6.

Figure 7:
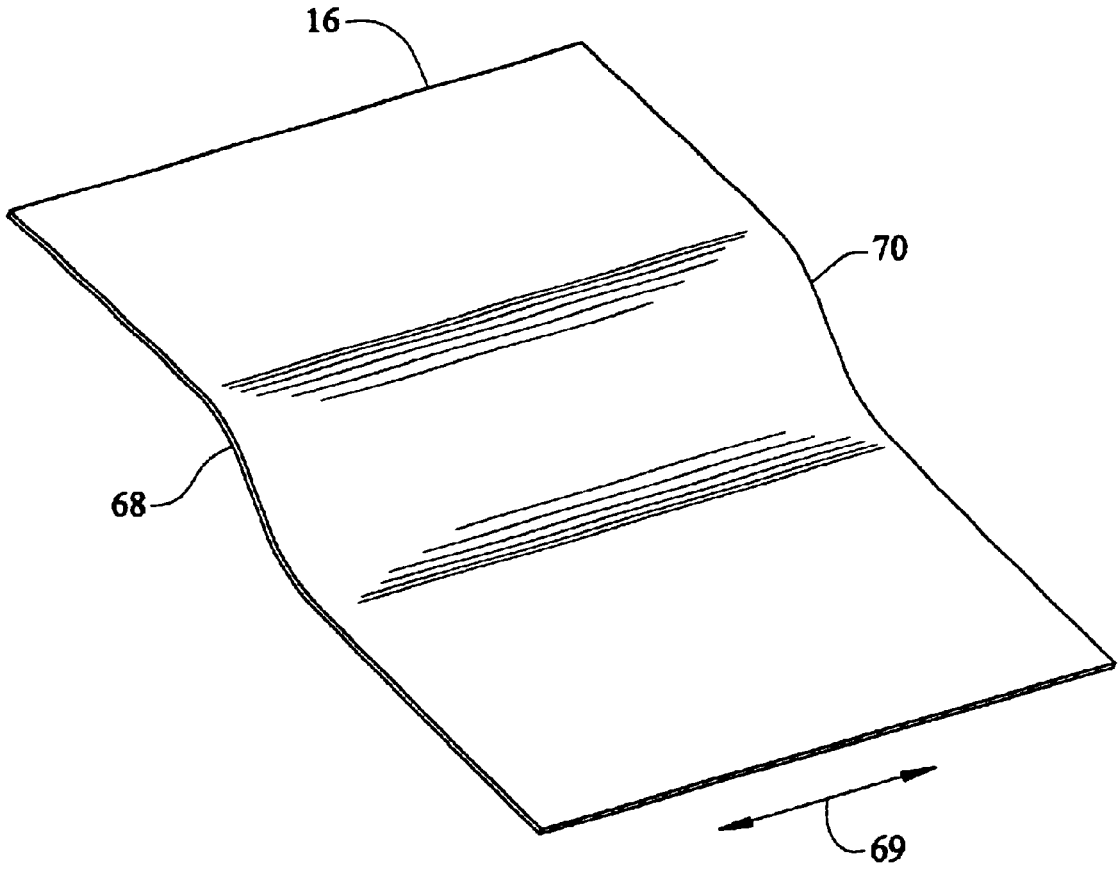
FIG. 7 is a schematic perspective view of a sheet of media showing when it is constrained on one of its side surfaces by the first reference edge.

The non-linear portions 51 (see FIG. 2) and 52 enable the sheet 16 (see FIG. 6) of media to twist so that the sheet 16 of media is simultaneously aligned with both the first reference edge segment 50 and the second reference edge segment 61. The media guide surface 65 of the first reference edge segment 50 constrains the adjacent side surface 68 of the sheet 16 of media, as indicated in FIG. 7, while its leading edge is free to move laterally, as indicated by arrows 69, into engagement with the media guide surface 67 (see FIG. 6) of the second reference edge segment 61.

Figure 8:
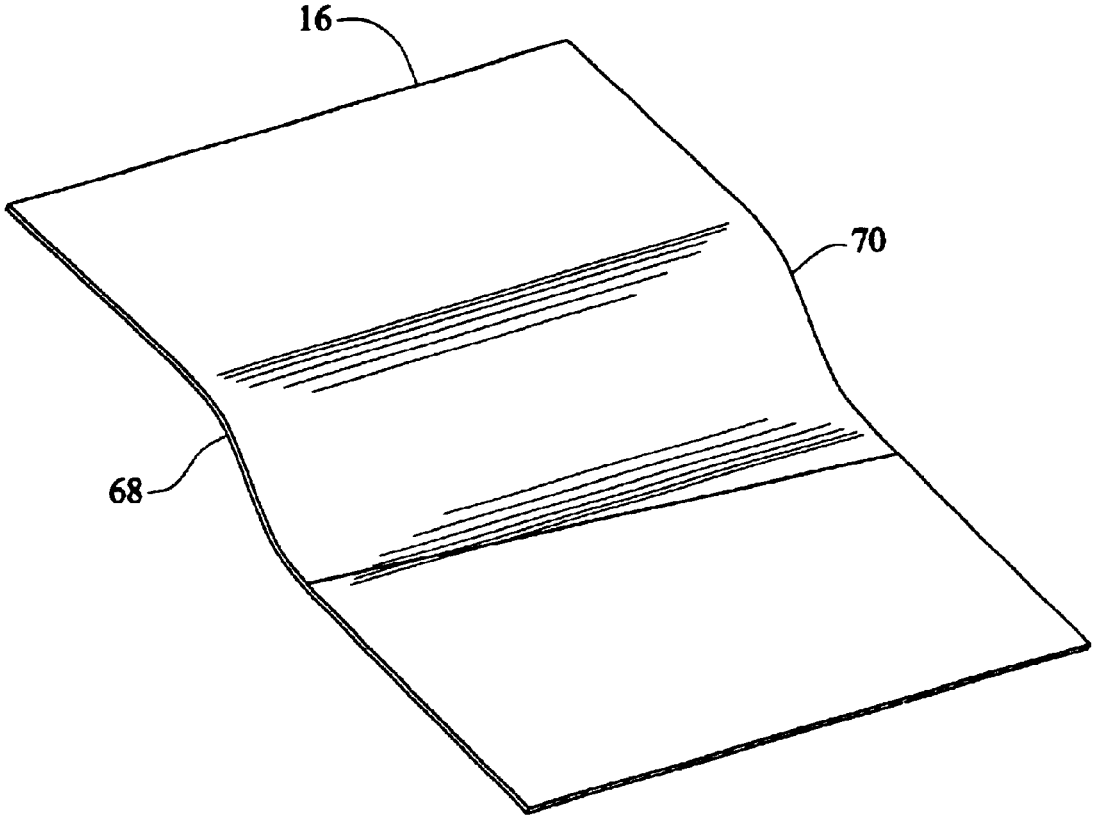
FIG. 8 is a schematic perspective view of the sheet of media of FIG. 7 showing when its one side surface is aligned by the second reference edge and the relation of its two side surfaces relative to each other.

In the non-linear portions 51 (see FIG. 2) and 52, the sheet 16 (see FIG. 3) of media has its side surface 68 (see FIG. 8), which is engaging the media guide surface 65 (see FIG. 3) of the first reference edge segment 50 and the media guide surface 67 of the second reference edge segment 61, shortened, as indicated in FIG. 8, while its opposite side surface 70 is lengthened. This results from the beam of the sheet 16 of media being broken so that this motion of the sheet 16 of media can occur.

Most of the force exerted by each of the alignment rollers 44 (see FIG. 3) and 57 is in the advancing direction of each of the sheets 16 of media. The skewing of each of the alignment rollers 44 and 57 by 5° provides sufficient force to move the side surface 68 of each of the sheets 16 of media against each of the media guide surfaces 65 and 67 of the first reference edge segment 50 and the second reference edge segment 61, respectively.

Figure 9:
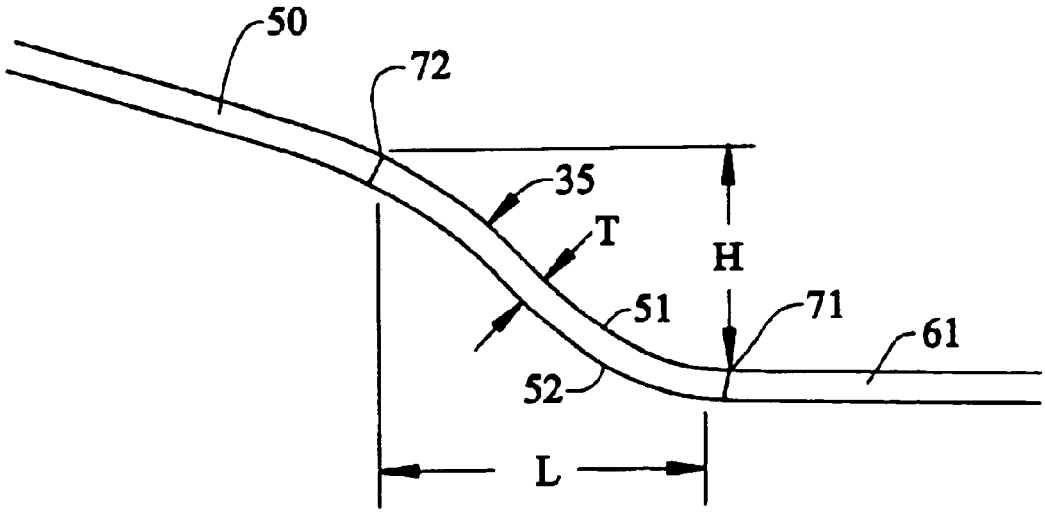
FIG. 9 is a schematic side elevational view of a portion of the media alignment mechanism showing how the optimal shape of the non-linear portions may be determined.

As shown in FIG. 9, the optimal S shape geometry of each of the non-linear portions 51 and 52, which are the same, is dependent upon the dimension of the height H from the non-linear portion 51 at end 71 of the second reference edge segment 61 to end 72 of the first reference edge segment 50 and the dimension of the length L of each of the non-linear portions 51 and 52 between the end 71 of the second reference edge segment 61 and the end 72 of the first reference edge segment 50. The optimal S shape geometry of each of the non-linear portions 51 and 52 also is dependent upon the forces exerted by the alignment rollers 44 (see FIG. 3) and 57. It is desired for the dimension of H (see FIG. 9) to be as large as possible to provide maximum space for other hardware and the dimension of L to be as small as possible for the same reasons.

The drag forces on each of the sheets 16 (see FIG. 3) of media in the non-linear portions 51 (see FIG. 9) and 52 are increased as the H dimension is increased and the L dimension decreased. While an increase in the dimension of T, the width of the predetermined return feed path 35, should reduce the drag forces, this cannot be increased beyond the point where each of the sheets 16 (see FIG. 3) of media cannot be controlled well. Accordingly, these drag forces must be balanced with the requirements to both align each of the sheets 16 of media with the first reference edge segment 50 and the second reference edge segment 61 and feed each of the sheets 16 of media forward along the predetermined return feed path 35 (see FIG. 1).

For purposes of exemplification, an exemplary embodiment of the invention has been shown and described according to the best present understanding thereof. However, it will be apparent that changes and modifications in the arrangement and construction of the parts thereof may be resorted to without departing from the spirit and scope of the invention.

It should be understood that any other type of printer than the laser printer 10 may utilize the media alignment mechanism of the present invention.

What is claimed is:

1. A media alignment mechanism for aligning each sheet of media with a reference edge for providing a desired media alignment direction during its advancement along a predetermined path comprising:

a pair of spaced elements defining the predetermined path along which each sheet of media is advanced and having a substantially constant space therebetween;

a first reference edge segment supported for disposition between said pair of spaced elements, said first reference edge segment having a media engaging surface for initially engaging a portion of a sheet of media as it is advanced relative to said first reference edge segment;

first advancing means for advancing a side surface of the sheet of media into said media engaging surface of said first reference edge segment and along said media engaging surface of said first reference edge segment;

a second reference edge segment spaced from said first reference edge segment in the direction of advancement of the sheet of media, said second reference edge segment supported for disposition between said pair of spaced elements, said second reference edge segment having a media engaging surface for engaging a portion of the sheet of media as it is advanced relative to said second reference edge segment;

second advancing means for advancing the side surface of the sheet of media into said media engaging surface of said second reference edge segment and along said media engaging surface of said second reference edge segment to align the sheet of media with said media engaging surface of said second reference edge segment;

said second reference edge segment having said media engaging surface providing the desired media alignment direction;

each of said pair of spaced elements having a non-linear portion between said first reference edge segment and said second reference edge segment for supporting and guiding the sheet of media during its advancement from said first reference edge segment to said second reference edge segment, said non-linear portions having a shape to break the beam of the sheet of media during its advancement through the space between said non-linear portions to enable a side surface of the sheet of media to be moved by said second advancing means into alignment with said media engaging surface of said second reference edge segment when the sheet of media engages said media engaging surface of said second reference edge segment while the side surface of the sheet of media is simultaneously in engagement with said media engaging surface of said first reference edge segment;

and said media engaging surface of said first reference edge segment being angled relative to said media engaging surface of said second reference edge segment so that the sheet of media has its leading edge pass inwardly of a media entry end of said second reference edge segment after its advancement through the space between said pair of non-linear portions to insure that the leading edge of the sheet of media does not engage the media entry end of said second reference edge segment.

2. The media alignment mechanism according to claim 1 comprising each of said first reference edge segment and said second reference edge segment being supported by at least one of said pair of spaced elements.

3. The media alignment mechanism according to claim 2 in which each of said pair of non-linear portions has a substantially S shape profile.

4. The media alignment mechanism according to claim 3 comprising:

said first advancing means applying a force to the sheet of media at an angle other than 90° to said media engaging surface of said first reference edge segment during its advancement to urge the sheet of media both against said media engaging surface of said first reference edge segment and along said media engaging surface of said first reference edge segment;

and said second advancing means applying a force to the sheet of media at an angle other than 90° to said media engaging surface of said second reference edge segment during its advancement to urge the sheet of media both against said media engaging surface of said second reference edge segment and along said media engaging surface of said second reference edge segment.

5. The media alignment mechanism according to claim 2 comprising:

said first advancing means applying a force to the sheet of media at an angle other than 90° to said media engaging surface of said first reference edge segment during its advancement to urge the sheet of media both against said media engaging surface of said first reference edge segment and along said media engaging surface of said first reference edge segment;

and said second advancing means applying a force to the sheet of media at an angle other than 90° to said media engaging surface of said second reference edge segment during its advancement to urge the sheet of media both against said media engaging surface of said second reference edge segment and along said media engaging surface of said second reference edge segment.

6. The media alignment mechanism according to claim 1 in which each of said pair of non-linear portions has a substantially S shape profile.

7. The media alignment mechanism according to claim 6 comprising:

said first advancing means applying a force to the sheet of media at an angle other than 90° to said media engaging surface of said first reference edge segment during its advancement to urge the sheet of media both against said media engaging surface of said first reference edge segment and along said media engaging surface of said first reference edge segment;

and said second advancing means applying a force to the sheet of media at an angle other than 90° to said media engaging surface of said second reference edge segment during its advancement to urge the sheet of media both against said media engaging surface of said second reference edge segment and along said media engaging surface of said second reference edge segment.

8. The media alignment mechanism according to claim 1 comprising:

said first advancing means applying a force to the sheet of media at an angle other than 90° to said media engaging surface of said first reference edge segment during its advancement to urge the sheet of media both against said media engaging surface of said first reference edge segment and along said media engaging surface of said first reference edge segment;

and said second advancing means applying a force to the sheet of media at an angle other than 90° to said media engaging surface of said second reference edge segment during its advancement to urge the sheet of media both against said media engaging surface of said second reference edge segment and along said media engaging surface of said second reference edge segment.

9. In a duplexer for use with a printer, a media alignment mechanism for aligning each sheet of media with a reference edge for providing a desired media alignment direction during its advancement along a predetermined return feed path in its return to a predetermined area of the printer for printing on its second side comprising:

a pair of spaced elements defining the predetermined return feed path along which each sheet of media is advanced and having a substantially constant space therebetween;

a first reference edge segment supported for disposition between said pair of spaced elements, said first reference edge segment having a media engaging surface for initially engaging a portion of a sheet of media as it is advanced relative to said first reference edge segment;

first advancing means for advancing a side surface of the sheet of media into said media engaging surface of said first reference edge segment and along said media engaging surface of said first reference edge segment;

a second reference edge segment spaced from said first reference edge segment in the direction of advancement of the sheet of media, said second reference edge segment supported for disposition between said pair of spaced elements, said second reference edge segment having a media engaging surface for engaging a portion of the sheet of media as it is advanced relative to said second reference edge segment;

second advancing means for advancing the side surface of the sheet of media into said media engaging surface of said second reference edge segment and along said media engaging surface of said second reference edge segment to align the sheet of media with said media engaging surface of said second reference edge segment;

said second reference edge segment having said media engaging surface providing the desired media alignment direction;

each of said pair of spaced elements having a non-linear portion between said first reference edge segment and said second reference edge segment for supporting and guiding the sheet of media during its advancement from said first reference edge segment to said second reference edge segment, said non-linear portions having a shape to break the beam of the sheet of media during its advancement through the space between said non-linear portions to enable a side surface of the sheet of media to be moved by said second advancing means into alignment with said media engaging surface of said second reference edge segment when the sheet of media engages said media engaging surface of said second reference edge segment while the side surface of the sheet of media is simultaneously in engagement with said media engaging surface of said first reference edge segment;

and said media engaging surface of said first reference edge segment being angled relative to said media engaging surface of said second reference edge segment so that the sheet of media has its leading edge pass inwardly of a media entry end of said second reference edge segment after its advancement through the space between said pair of non-linear portions of the predetermined return feed path to insure that the leading edge of the sheet of media does not engage the media entry end of said second reference edge segment.

10. The media alignment mechanism in a duplexer according to claim 9 comprising each of said first reference edge segment and said second reference edge segment being supported by at least one of said pair of spaced elements.

11. The media alignment mechanism in a duplexer according to claim 10 in which each of said pair of non-linear portions has a substantially S shape profile.

12. The media alignment mechanism in a duplexer according to claim 11 comprising:

said first advancing means applying a force to the sheet of media at an angle other than 90° to said media engaging surface of said first reference edge segment during its advancement to urge the sheet of media both against said media engaging surface of said first reference edge segment and along said media engaging surface of said first reference edge segment;

and said second advancing means applying a force to the sheet of media at an angle other than 90° to said media engaging surface of said second reference edge segment during its advancement to urge the sheet of media both against said media engaging surface of said second reference edge segment and along said media engaging surface of said second reference edge segment for return to the predetermined area of the printer in the desired media alignment direction for printing on its second side.

13. The media alignment mechanism in a duplexer according to claim 10 comprising:

said first advancing means applying a force to the sheet of media at an angle other than 90° to said media engaging surface of said first reference edge segment during its advancement to urge the sheet of media both against said media engaging surface of said first reference edge segment and along said media engaging surface of said first reference edge segment;

and said second media advancing means applying a force to the sheet of media at an angle other than 90° to said media engaging surface of said second reference edge segment during its advancement to urge the sheet of media both against said media engaging surface of said second reference edge segment and along said media engaging surface of said second reference edge segment for return to the predetermined area of the printer in the desired media alignment direction for printing on its second side.

14. The media alignment mechanism in a duplexer according to claim 9 in which each of said pair of non-linear portions has a substantially S shape profile.

15. The media alignment mechanism in a duplexer according to claim 14 comprising:

said first advancing means applying a force to the sheet of media at an angle other than 90° to said media engaging surface of said first reference edge segment during its advancement to urge the sheet of media both against said media engaging surface of said first reference edge segment and along said media engaging surface of said first reference edge segment;

and said second advancing means applying a force to the sheet of media at an angle other than 90° to said media engaging surface of said second reference edge segment during its advancement to urge the sheet of media both against said media engaging surface of said second reference edge segment and along said media engaging surface of said second reference edge segment for return to the predetermined area of the printer in the desired media alignment direction for printing on its second side.

16. The media alignment mechanism in a duplexer according to claim 9 comprising:

said first advancing means applying a force to the sheet of media at an angle other than 90° to said media engaging surface of said first reference edge segment during its advancement to urge the sheet of media both against said media engaging surface of said first reference edge segment and along said media engaging surface of said first reference edge segment;

and said second advancing means applying a force to the sheet of media at an angle other than 90° to said media engaging surface of said second reference edge segment during its advancement to urge the sheet of media both against said media engaging surface of said second reference edge segment and along said media engaging surface of said second reference edge segment for return to the predetermined area of the printer in the desired media alignment direction for printing on its second side.

17. A method of aligning each sheet of media with a reference edge during its advancement along a predetermined path to provide a desired media alignment comprising:

advancing a sheet of media along the predetermined path to initially engage a media engaging surface of a first reference edge segment, disposed at a predetermined position along the predetermined path, for advancement of the sheet of media into engagement with the media engaging surface of the first reference edge segment and along the media engaging surface of the first reference edge segment;

advancing the sheet of media along the predetermined path to engage a media engaging surface of a second reference edge segment spaced from the media engaging surface of the first reference edge segment in the direction of advancement of the sheet of media and in a direction to clear the entry end of the media engaging surface of the second reference edge segment due to the media engaging surface of the first reference edge segment being at an angle to the media engaging surface of the second reference edge segment to so direct the sheet of media;

and breaking the beam of the sheet of media between the first reference edge segment and the second reference edge segment to enable a side surface of the sheet of media to move into engagement with the media engaging surface of the second reference edge segment while the sheet of media is simultaneously engaging the media engaging surface of the first reference edge segment as the sheet of media is advanced to align the sheet of media with the media engaging surface of the second reference edge segment to provide the desired media alignment.

18. The method according to claim 17 comprising breaking the beam of the sheet of media by forming the portion of the predetermined path between the first reference edge segment and the second reference edge segment with a non-linear profile.

19. The method according to claim 17 comprising breaking the beam of the sheet of media by forming the portion of the predetermined path between the first reference edge segment and the second reference edge segment in a substantially S shape profile.

20. A method of aligning each sheet of media in a duplexer for use with a reference edge during its advancement along a predetermined return feed path to provide a desired media alignment in its return to a predetermined area of the printer for printing on its second side comprising:

advancing a sheet of media along the predetermined return feed path to initially engage a media engaging surface of a first reference edge segment, disposed at a predetermined position along the predetermined return feed path, for advancement of the sheet of media into engagement with the media engaging surface of the first reference edge segment and along the media engaging surface of the first reference edge segment;

advancing the sheet of media along the predetermined return feed path from the media engaging surface of the first reference edge segment to engage a media engaging surface of a second reference edge segment spaced from the media engaging surface of the first reference edge segment in the direction of advancement of the sheet of media and in a direction to clear the entry end of the media engaging surface of the second reference edge segment due to the media engaging surface of the first reference edge segment being at an angle to the media engaging surface of the second reference edge segment to so direct the sheet of media;

and breaking the beam of the sheet of media between the first reference edge segment and the second reference edge segment to enable a side surface of the sheet of media to move into engagement with the media engaging surface of the second reference edge segment while the sheet of media is simultaneously engaging the media engaging surface of the first reference edge segment as the sheet of media is advanced to align the sheet of media with the media engaging surface of the second reference edge segment for return along the predetermined return feed path to the predetermined area of the printer in the desired media alignment direction for printing on the second side.

21. The method according to claim 20 comprising breaking the beam of the sheet of media by forming the portion of the predetermined return feed path between the first reference edge segment and the second reference edge segment with a non-linear profile.

22. The method according to claim 20 comprising breaking the beam of the sheet of media by forming the portion of the predetermined return feed path between the first reference edge segment and the second reference edge segment in a substantially S shape profile.

* * * * *